US006000354A

United States Patent [19]

Vanlerberghe

[11] Patent Number: 6,000,354

[45] Date of Patent: Dec. 14, 1999

[54] J.P.V.'S TELESCOPING MAST

[76] Inventor: John Patrick Vanlerberghe, 328 E. Jefferson, Grand Ledge, Mich. 48837

[21] Appl. No.: 09/076,988

[22] Filed: May 13, 1998

[51] Int. Cl.[6] ..... B63B 15/00

[52] U.S. Cl. ..... 114/90

[58] Field of Search ..... 114/88, 90, 91, 114/102, 103

[56] References Cited

U.S. PATENT DOCUMENTS

| | | | |
|---|---|---|---|
| 3,838,655 | 10/1974 | Kratz | 114/90 |
| 4,016,823 | 4/1977 | Davis | 114/90 |
| 4,047,492 | 9/1977 | Brown | 114/90 |

*Primary Examiner*—Stephen Avila

[57] ABSTRACT

A telescoping mast for conversion of a sailboat. A mast consisting of two portions—an upper telescoping portion which is journalled to telescope up from and retract down into the lower portion (trunk). The mast is located somewhat midst to forward of a sailboat where it is supported by a tabernacle (base) which allows for pivoting of the mast back and down toward the cockpit. The mast is also supported by cables (i.e., shrouds and stays). The said telescoping portion is raised by a line (rope, cable, etc.) attached to the bottom portion of said telescoping portion and runs to the top of the said trunk (lower portion). The line then is captured by a pulley whereby the line is redirected down the outside of the said mast trunk to the deck area. The telescoping portion, when extended (telescoped), is secured in place to the said trunk portion by a pivoting fork journalled within the said telescoping portion.

6 Claims, 3 Drawing Sheets

J.P.V.'S TELESCOPING MAST

TELESCOPING MAST

The present invention pertains to sailboats and more particularly to the provision for a selectively telescoping mast, which the upper portion is retracted down into the lower portion, allowing the mast to be lowered toward the aft portion of the boat. In a specific sense, the present invention seeks to allow the lowering of a mast without having to detach any of the supporting cables (i.e., side shrouds, fore and aft stays) while keeping sails attached. This specific invention seeks to allow for fast readiness for sailing as well as trailering.

Accordingly, the principal object is to teach the lower portion of the trunk to accept the upper portion allowing it to fall toward the back of the sailboat in a projected plane of the mast.

Another object is to provide a structure useful in smaller sailboats which is manually operable from the cockpit.

Another object is to provide a mast having three principal positions (i.e., mast raised with upper portion fully telescoped, mast with top portion retracted into lower portion, and the retracted mast lowered back and down toward back of boat).

Another object is to achieve a transition for the mainsail from the lower mast portion to the upper telescoping portion of the mast.

Another object is to achieve the security on the top lower portion of the mast for the telescoping portion of the mast when extended.

Still other objects including simplicity, economy, and relatively simple conversion of new as well as existing sailboats will be appreciated more fully as the description proceeds.

Another object is to recognize the forestay as an instrumental part in controlling the downward fall in a projected plane toward the transom of the boat. The forestay works in concert with the raising line.

GENERAL DESCRIPTION

In general, the present invention is directed to a telescope-mast structure for sailboats and especially trailerable sailingcraft for conversion of a full length mast to a smaller mast for trailerability. The principal elements of the structure are the lower section of the mast located on deck approximately midsection which acts as a trunk for the upper portion of the mast when retracted and extended. The upper portion of the mast is supported by the lower section, shrouds and stays. The position of the mast is manipulated by a line attached to the bottom of the inside telescoping portion of the mast that connects to the top of the outside mast portion or trunk and extends down to the deck where it is controlled. The position of the line is manipulated to lower and raise the mast. Stop means are included which selectively secure the telescoping portion in the operative and inoperative positions. The entire mast content is secured at the bottom by means of a tabernacle structure which acts as a pivotal means for the mast to be lowered in the projected plane of the mast toward the transom (i.e., back of boat).

Details of this construction and the preferred embodiment thereof will be increasingly appreciated as the description proceeds and the drawings are understood.

IN THE DRAWINGS

SPECIFIC DESCRIPTION

Figure 1:
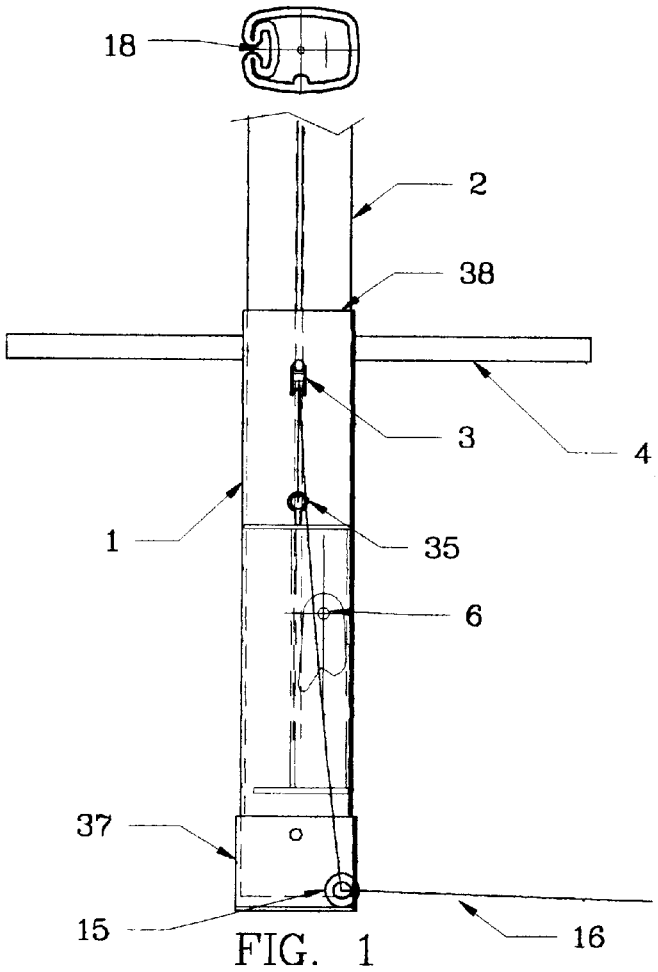
FIG. 1 is a cutaway perspective view of the mast showing the inner telescoping portion.

Referring to the drawings and with first specific reference to the FIG. 1 thereof, the telescoping mast structure installed on a sailboat or sailcraft. The mast trunk 1 is seen located somewhat midship. The mast trunk 1 holds the telescoping portion 2. The telescoping portion 2 is raised by line 16. Line 16 runs from the cockpit to the base of the mast 37 where the line is accepted by a pulley 15. This line then runs up to the top of the mast trunk 38 (first portion of the mast) where it is accepted by pulley 3. This line then continues down the inside of the first portion of the mast 1 and the outside of the telescoping mast portion 2 to a connecting spot 35. As line 16 is moved forward, the inner mast portion 2 is forced up.

Figure 2:
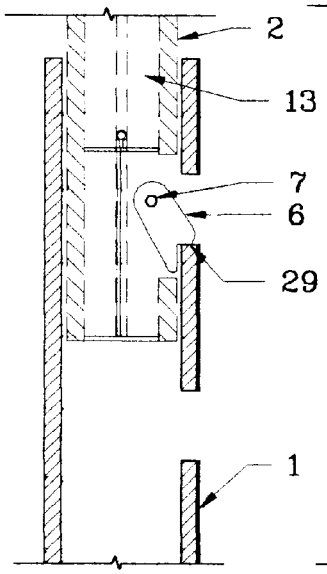
FIG. 2 is a cutaway perspective view indicating the locking of the telescoping portion of the mast into position.

In FIG. 2 the fork locking system is seen secured in a cavity 13 toward the bottom of the telescoping portion of the mast 2 and shown secured to the lower mast portion 1 at the top 29 by a fork 6.

Figure 3:
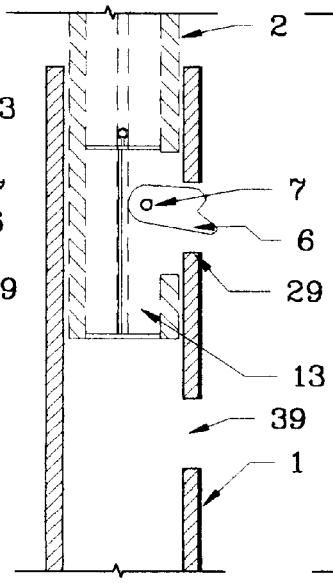
FIG. 3 is a cutaway perspective view indicating the unlocking of the telescoping portion of the mast.

FIG. 3 shows the appreciation of the unlocking of the telescoping portion 2 from lower trunk position 1 by raising the telescoping portion 2 slightly thus allowing the fork to spring out. The telescoping portion is now ready to retract down into 1.

Figure 4:
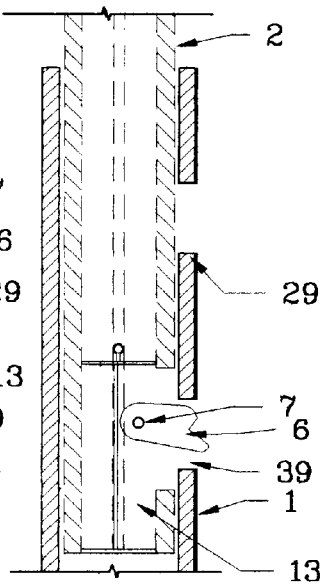
FIG. 4 is a cutaway perspective view indicating the resetting of the telescoping portion of the mast.

FIG. 4 shows how the telescoping portion 2 can be reset by lowering the, locking portion 6 of the telescoping portion 2 to the opening in the mast trunk 1 where the fork 6 attached to a spring on axle 7 causes fork 6 to spring out so as to allow it to be raised into position 29 as seen on FIG. 2.

Figure 5:
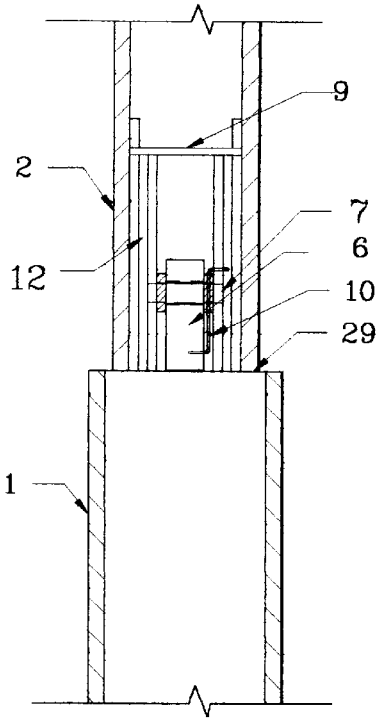
FIG. 5 is an exploded perspective view of the locking system indicating stop provisions with stress plate over axle which holds the pivoting fork used as a stop means.

FIG. 5 shows the locking assembly of the telescoping mast portion 2 onto 1. The locking assembly indicates the fork 6 which pivots on axle 7. The fork 6 is attached to a spring 10 which allows the fork 6 when freed from being secured on 29 to assume a position approximately 90 degrees to 2. Axle 7 is indicated as being secured to 8 and supported by a stress block 9 secured to both sides of 2. The base of the stress bar embodies axle 7 approximately 180 degrees transversely as seen at 12. Axle 7 is again attached on both sides to 2.

Figure 6:
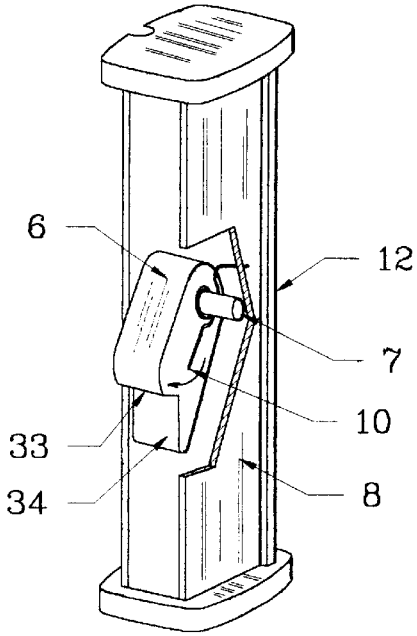
FIG. 6 is an exploded perspective view of the fork portion of the locking assembly.

FIG. 6 shows an explosion view of the fork portion of the locking assembly. Portion 33 of fork 6 rests on the ledge 29 of the lower trunk mast 1 with portion 34 of fork 6 resting longitudinally against 1 causing the telescoping mast 2 to be secured to the mast trunk portion 1. The spring 10 is secured at one end to the opening of the stress bar 9, and secured at the other end on the side of fork 6 at 10.

Figure 7:
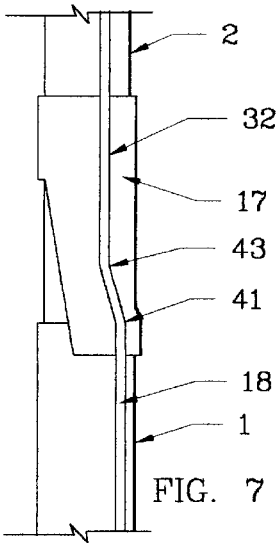
FIG. 7 is a perspective view of the transitional cap to provide the sail transition from the lower portion to the telescoping portion of the mast.

FIG. 7 shows a transition cap 17 which is attached to the lower mast trunk 1. 17 is not attached to the telescoping mast portion 2. 17 allows the telescoping mast portion 2 to move freely through it. The open track 18 transcends from point 41 to 43 where it joins to track 32. Track 18 allows the movement of the sail from the lower trunk portion 1 to the upper telescoping portion 2. The wider cutout 32 of mast portion 2 allows for easy transition of the mainsail from mast I to mast 2.

Figure 8:
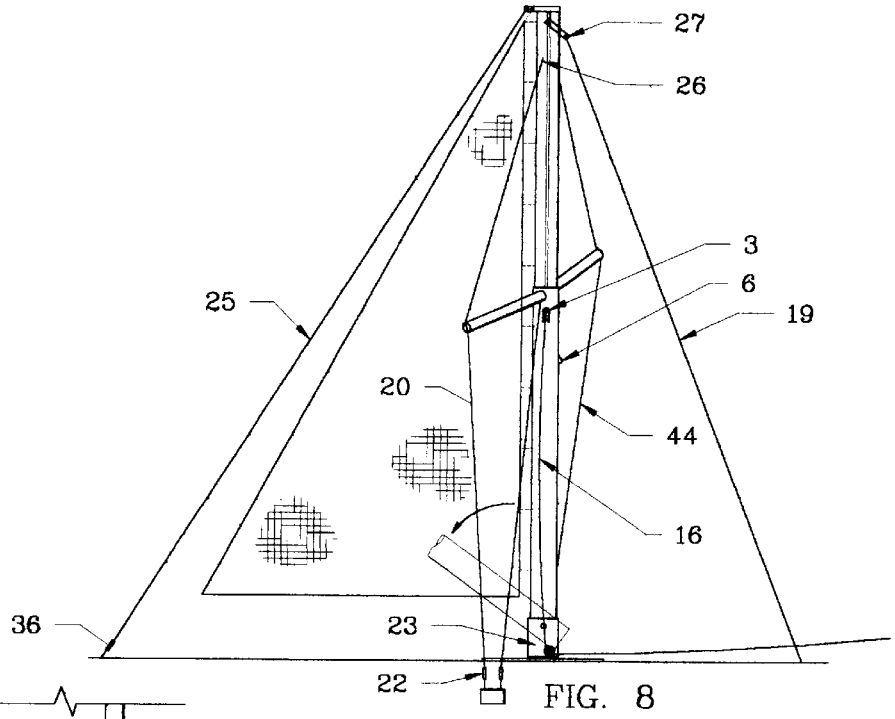
FIG. 8 is a perspective view of the mast assembly and quick release back stay and shroud levers.

FIG. 8 shows quick release shroud adjusters 22 and 44 and quick release back stay adjuster 36 which are used to take up the slack in 20, 25 and 44 caused by the locking assembly shown in FIG. 5. The slack is necessary for the locking and release of fork 6.

Figure 11:
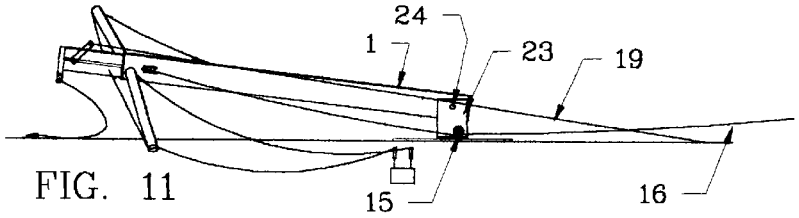
FIG. 11 is a perspective view of the mast assembly in its lowered positon.
Figure 10:
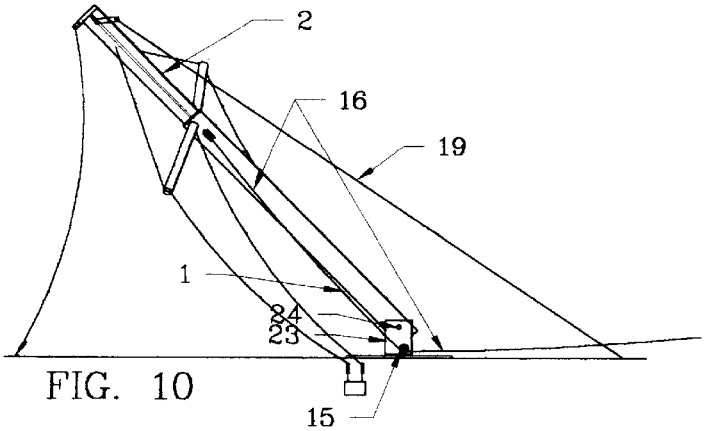
FIG. 10 is a perspective view of the mast assembly in its partial lowered position.
Figure 9:
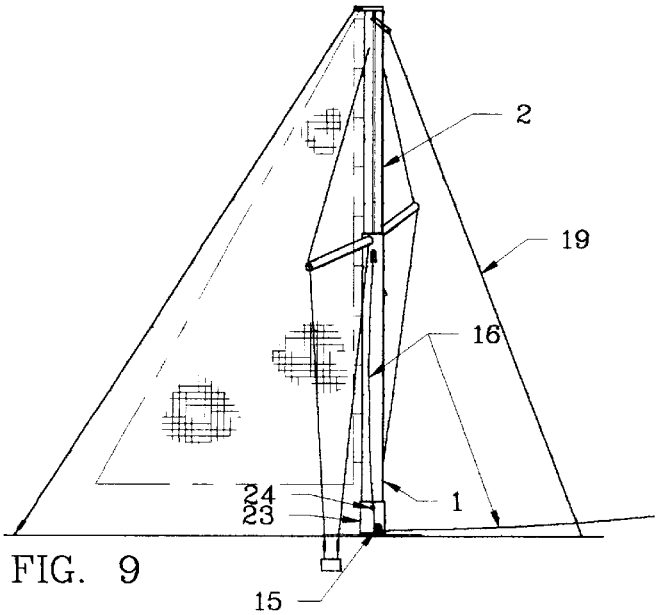
FIG. 9 is a perspective view of the mast assembly in its operative position.

FIG. 9, FIG. 10 and FIG. 11 show the progression of the mast being lowered in a projected plane toward the transom of the boat. The mast 1 and 2 are shown pivoting off the axle 24 located approximately one foot up from the base of the tabernacle 23. The mast is controlled by line 16 working in concert with the forestay 19. As line 16 is relaxed, mast 2 is retracted and lowered simultaneously while being supported by forestay 19. 15 shows a winch which allows for ease in raising and lowering the mast.

Figure 12:
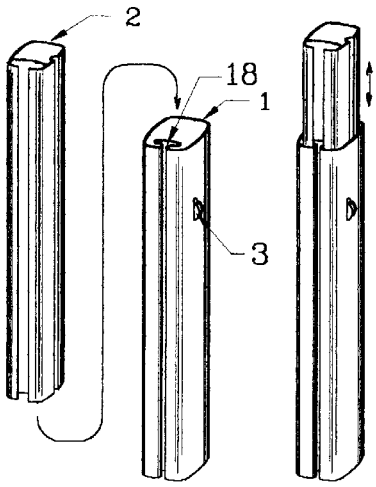
FIG. 12 is a mast detail.

FIG. 12 shows mast trunk 1, telescoping portion 2, track 18, and pulley 3.

Having thus described my invention and the preferred embodiment thereof, those skilled in the art will readily perceive changes, modifications and improvements within the skill of the art. Such changes, modifications and improvements are intended to be included herein limited only by the scope of my hereinafter appended claims.

I claim:

1. A combination of a telescoping and pivoting sailboat mast, working in concert, comprising a plurality of hollowed tubular sections telescopingly interconnected whereby a locking means secures said tubular sections, maintaining a fully extended position, said hollowed sections when extended, follow in an aligned manner along a longitudinal sail slide channel, said hollowed telescoping sections are extended and contracted by raising means and lowering means, said raising means lifts and extends fully the telescoping hollowed sections to a secured reinforced slot, by a locking means, in the longitudinal plane, said hollowed telescoping sections mast is supported by a forestay running from the top of a smaller inside telescoping hollowed tubular section to a forward portion on the boat deck, said raising means and said lowering means have a line running from a larger outside hollowed tubular section and running in common longitudinal plane to the lower portion of the smaller mast raising and lowering as well as the securing and unsecuring of said interconnected hollowed tubular sections, said mast is supported by means of a mechanism secured to the deck, said mechanism allows for pivoting of the said mast.

2. A telescoping mast as set forth in claim 1 and further comprising a locking housing encompassing a fork, a spring, a slot opening, an axle, said housing is captured within the walls and toward the base of the smaller inside hollowed telescoping section of said plurality of hollowed sections, said fork disposed within said housing, said fork held approximately perpendicular to and towards said common longitudinal axis, said fork protruding through said slot of said housing of said hollowed telescoping section by means of said spring, said spring is captured on an axle where said fork pivots, said spring is secured both on the said fork and on the wall supporting said axle, said spring urges said fork to return to perpendicular status when said fork is aligned with the slot of the larger adjacent outer hollowed tubular section when said fork is secured.

3. A telescoping mast as set forth in claim 1 and further comprising a sail slide channel means encompassing sail slides, sail side channels, said channels run perpendicular from the outer surface of said mast sections toward the middle of a tubular opening, said channels run substantially the length of said mast sections in a longitudinal manner, said sail slide channel of said inside adjacent tubular section surrounds the sail slide channel of said larger adjacent outer tubular section, holding said sail side channels aligned, said sail slides, of which a sail is attached, transitions within said sail slide channel of said adjacent lower outer tubular section to within the inside channel of said adjacent inside telescoping tubular section when said mast is extended, said sail slide transitions back within the channel of said adjacent lower outside tubular section when said mast is reclined.

4. A telescoping mast as set forth in claim 1 and further comprising said raising means further includes a groove within the outer skin of said adjacent inside telescoping section, said groove runs substantially the length of said inside tubular section, on a longitudinal axis, said line terminates somewhat near the base of said smaller inside telescoping tubular section, said line when pulled, forces said telescoping inside tubular section up into an extended position.

5. A telescoping mast as set forth in claim 1 and further comprising a securing means, encompassing a reinforced slot, a platform, said reinforced slot located substantially toward the top of the outside larger tubular section, said reinforced slot, when the mast is substantially extended, aligns with a slot of said locking means of said adjacent smaller inside telescoping tubular section, said slots of each section are located on adjacent longitudinal planes, said platform is secured to the base of said reinforced slot where said locking fork rests.

6. A telescoping mast as set forth in claim 1 and further comprising a supporting means, encompassing a forestay, a tabernacle, a pin, shroud adjusters, said forestay running from the bow of a boat and terminating substantially toward the top of the mast, said forestay supports said mast while said mast is raised or lowered, said forestay remains taut as said mast sections telescopes while simultaneously pivoting up or when said mast section retract while simultaneously pivoting down in a longitudinal plane from the center of the boat's bow to the center of the boat's stern, said forestay by working in concert with raising means, prevents said mast from falling out of control, said mast's decent is due to the resistance of the raising line, said tabernacle which has parallel plates of which said mast is secured to a base of the boat by a pin which transverses through aligned adjacent holes in both parallel plated and mast, said tabernacle allows the mast to pivot in concert with said forestay and raising means, said shroud adjusters, located at the base of said supporting cables and terminating at both the port and starboard edges approximate to midboat, take the slack out of the supporting cables after the mast is extended and locked into position, said shroud adjusters also work to slacken the supporting cables prior to releasing the locking fork of said locking means.

* * * * *